US005532429A

United States Patent [19]

Dickerson et al.

[11] Patent Number: 5,532,429

[45] Date of Patent: Jul. 2, 1996

[54] COMPOSITE SHIELD JACKET FOR ELECTRICAL TRANSMISSION CABLE

[75] Inventors: Marvella Dickerson, Simpsonville; Douglas E. Piper, Greenville, both of S.C.

[73] Assignee: Woven Electronics Corp., Simpsonville, S.C.

[21] Appl. No.: 361,938

[22] Filed: Dec. 22, 1994

Related U.S. Application Data

[62] Division of Ser. No. 949,987, Sep. 24, 1992, Pat. No. 5,387,113.

[51] Int. Cl.[6] ..... H01B 7/34

[52] U.S. Cl. ..... 174/36; 156/54; 174/117 F; 174/117 M; 439/98; 439/497

[58] Field of Search ..... 174/35 C, 36, 174/117 F, 117 M; 439/98, 99, 497, 610; 156/54

[56] References Cited

U.S. PATENT DOCUMENTS

| | | | |
|---|---|---|---|
| 4,095,042 | 6/1978 | Ross | 174/36 |
| 4,130,334 | 12/1978 | Anderson | 174/78 |
| 4,229,615 | 10/1980 | Orr, Jr. et al. | 174/117 M |
| 4,281,211 | 7/1981 | Tatum et al. | 174/117 F |
| 4,352,531 | 10/1982 | Gutter | 439/497 |
| 4,409,427 | 10/1983 | Plummer, III | 174/36 |
| 4,416,501 | 11/1983 | Fusselman et al. | 439/99 |
| 4,437,724 | 3/1984 | Volka | 439/493 |
| 4,461,076 | 7/1984 | Plummer, III | 29/825 |
| 4,504,696 | 3/1985 | Piper | 174/117 M |
| 4,536,045 | 8/1985 | Reichardt et al. | 439/497 |
| 4,596,897 | 6/1986 | Gruhn | 174/36 |
| 4,639,545 | 1/1987 | Pithouse et al. | 174/36 |
| 4,684,762 | 8/1987 | Gladfelter | 174/36 |
| 4,731,500 | 3/1988 | Otusuka | 174/36 |
| 4,758,179 | 7/1988 | Klein et al. | 439/497 |
| 4,791,236 | 12/1988 | Klein et al. | 174/36 |
| 4,822,950 | 4/1989 | Schmitt | 174/36 |
| 4,868,565 | 9/1989 | Mettes et al. | 174/36 |
| 5,030,794 | 7/1991 | Schell et al. | 174/36 |
| 5,084,594 | 1/1992 | Cady et al. | 174/36 |
| 5,180,884 | 1/1993 | Aldissi | 174/36 |
| 5,367,123 | 11/1994 | Plummer, III et al. | 174/36 |
| 5,373,103 | 12/1994 | Orr, Jr. et al. | 174/36 |
| 5,391,838 | 2/1995 | Plummer, III | 174/36 |
| 5,416,268 | 5/1995 | Ellis | 174/36 |
| 5,434,354 | 7/1995 | Baker et al. | 174/36 |

*Primary Examiner*—Morris H. Nimmo
*Attorney, Agent, or Firm*—Cort Flint

[57] ABSTRACT

A composite shield jacket and woven electrical transmission cable assembly is disclosed wherein the shield jacket comprises an outer elastomeric cover and a metalized backing on the interior side of the cover which advantageously may comprise a thin flexible fibrous web formed either by weaving metallic coated fibers or forming a non-woven web from the metallic coated fibers, or by applying a thin metallic layer to the backside of the cover. In any case, a highly durable, flexible shield jacket is provided. When the jacket is applied to a flat transmission cable according to the invention, the side edges of the shield are on opposite sides of the cable so as to overlap the sides of the shield and cover so that exits from the shield are defined on opposing sides of the cable reducing the unwanted escape of interference noises. The flexible shield material is terminated by use of a resilient termination element which clips to the shield cloth and is resiliently retained inside a connector housing for termination to a ground plane of the connector. The invention may be applied to a round or tubular cable as well as a flat.

18 Claims, 12 Drawing Sheets

COMPOSITE SHIELD JACKET FOR ELECTRICAL TRANSMISSION CABLE

This is a divisional of application Ser. No. 07/949,987, filed on Sep. 24, 1992, now U.S. Pat. No. 5,387,113.

The invention relates to the shielding of electrical transmission cable from unwanted electrical noises, such as electromagnetic interference (EMI) and radiation interference (RFI).

In the past, flat woven electrical transmission cable has been shielded by wrapping a relatively stiff metal foil such as copper or aluminum around the cable. A layer of elastomeric material is wrapped around the metal shielding material for protection. An outer elastomeric cover has also been extruded over the conductive shield material. The outer elastomeric cover is an insulative material to protect against shorting or other conductive problems. In the prior art constructions, the metal foil is typically overlapped at the center of one side of the electrical transmission cable. The problem with the center lap shield is that, when the cable is folded or bent in use as is often the case, the foil material has a tendency to pucker and tent up which provides a space through which the emissions may escape. The center lap often provides a straight path which allows noise signals to escape easily. The multi-layer construction of the prior shield construction is relatively stiff and heavy, is not flexible enough for a lot of thin, flexible cable applications. U.S. Pat. No. 4,596,897 show a prior center overlap typical of the prior art folded shields. U.S. Pat. No. 5,030,794 is illustrative of prior shielding material surrounding flat ribbon cable.

SUMMARY OF THE INVENTION

This invention describes a shielded electrical transmission cable assembly having improved flexibility and shielding against unwanted electrical noise. The assembly includes a flat electrical transmission cable having a plurality of conductors arranged generally side by side. There is an electrical connector member terminating one end of the electrical transmission cable including a housing and a multi-position connector carried by the housing. A PC board is carried by the housing for terminating the electrical transmission cable to the connector which has a ground plane. A conductive shield cloth is wrapped about the electrical transmission cable for conducting unwanted electrical noise and an elastomeric cover surrounds the shield cloth. Preferably, the shield cloth is secured to the elastomeric cover to provide an integral composite shield jacket. The shield cloth advantageously consists of a flexible fibrous web which includes metallic coated fibers providing a highly flexible electrical shield jacket with increased durability when secured with the elastomeric cover in the cable assembly.

The shield cloth is overlapped at a first edge of the electrical transmission cable so that a first end of the shield cloth is disposed on a first side of the transmission cable and a second end of the shield cloth is disposed on a second side of the transmission cable to define first and second exits between the first and second ends of the shield cloth and the sides of the cable which are located on opposite sides of the electrical transmission cable for minimizing the escape of unwanted electrical noises. The shield cloth may be provided in the form of a web woven from metallic coated fibers, or a non-woven web formed from entangled metallic coated fibers. The shield cloth and elastomeric cover may be secured by a chemical bonding.

An electrical termination device for terminating the electrical transmission cable to the electrical connector includes an elongated electrically conductive element including a first contact, and a second contact. The cable is connected to the first contact of the element. The second contact of the termination element is constructed and arranged to contact the ground plane of the connector PC board when the element is enclosed within the housing. At least one of the contacts is resiliently constructed and arranged so that one contact is resiliently engaged between the housing and the ground plane with the ground plane terminating the shield cloth. For this purpose, the shield cloth may include a metallic cloth tab formed on an end of the shield which is electrically connected to the first contact. The first and second contacts of the elongated conductive element include respective first and second elongated contact strips. At least the second contact strip includes a plurality of individual segments which are independently resilient to assure uniform contact and conduction with the ground plane. The first and second contact strips are connected together by at least one flexible bend by which at least the second contact strip is resilient with respect to the first contact strip. The first contact of the conductive element constitutes a clip which attaches to the cloth shield.

In accordance with the invention, a method for producing a composite shield jacket is disclosed for electrically shielding and protecting a flat electrical transmission cable includes providing elastomeric material to form an outer cover; and providing a conductive shield cloth to form an inner layer for conducting unwanted electrical noises. Quite advantageously, the shield cloth comprises a flexible fibrous web formed from metallic coated fibers providing a highly flexible shield. Preferably, the elastomeric material and shield cloth are secured together to form a composite tubular jacket having increased structural integrity. Next, the composite tubular jacket is subjected to a process which flattens the tubular jacket and forms a flat shield jacket having substantially creased edges to provide increased flexibility. The method includes securing the shield cloth and elastomeric material together by bonding to enhance the structural integrity of the shield jacket.

In particular, the method includes forming the shield jacket so that a first end of the shield cloth is disposed on a first side of an enclosed transmission cable and a second end of the shield cloth is disposed on a second side of the transmission cable. First and second exits are thus defined between first and second ends of the shield cloth and first and second sides of the cable which are located on opposite sides of the electrical transmission cable to define a curved exit path and whereby the escape of unwanted electrical noises is minimized.

When the shield material is overlapped at the edges, as in the case of the present invention, if there is a pucker on one side, the unwanted emissions must go around the corner of the cable to the other side where the shield material is held tight. By having the opposing edges of the overlap on the corners there is always pressure on the edge opposite the pucker so that the shielding material is secured tightly and prevents the escape of emissions. Instead of a straight line, interference noise must travel in a curved path reducing substantially their escapement.

By bonding an elastomeric material such as urethane, with a shield cloth constructed from a fibrous web having metallic coated fibers, a result in strength is achieved which is stronger than the two materials separately utilized. The copper coated material may be provided in a non-woven form, or a woven form. In the woven form, either a plain weave or other weaves may be utilized, such as a rip-stop weave which is preferred due to the fact that it is lighter in weight due to a sacrificing strength.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF THE PREFERRED EMBODIMENT

Figures 2, 2A:
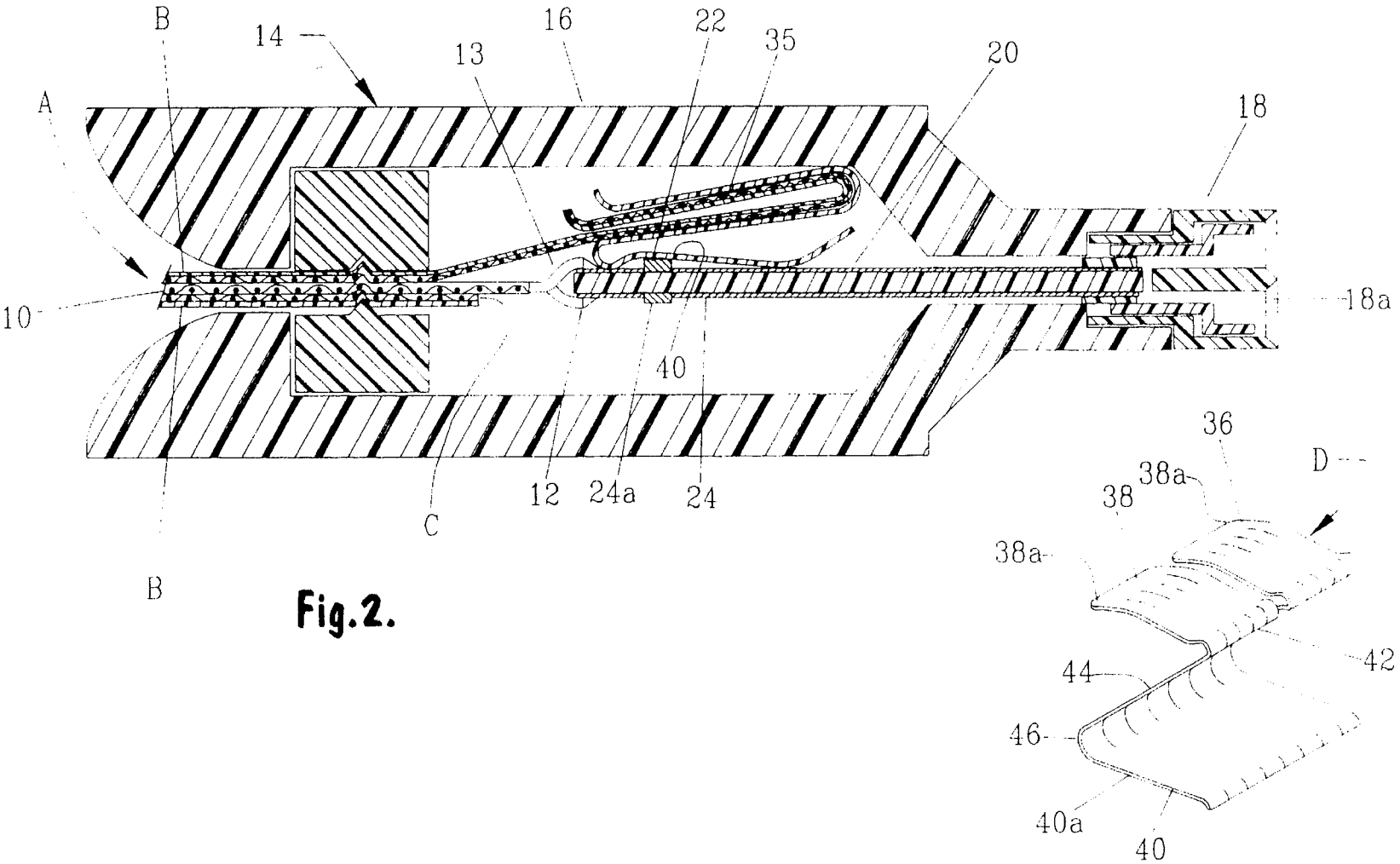
FIG. 2 is a sectional view taken along line 2—2 of FIG. 1.
FIG. 2*a* is a perspective view illustrating an electrical termination device utilized to terminate a conductive shield cloth which surrounds the woven electrical transmission cable for shielding according to the invention.
Figure 13:
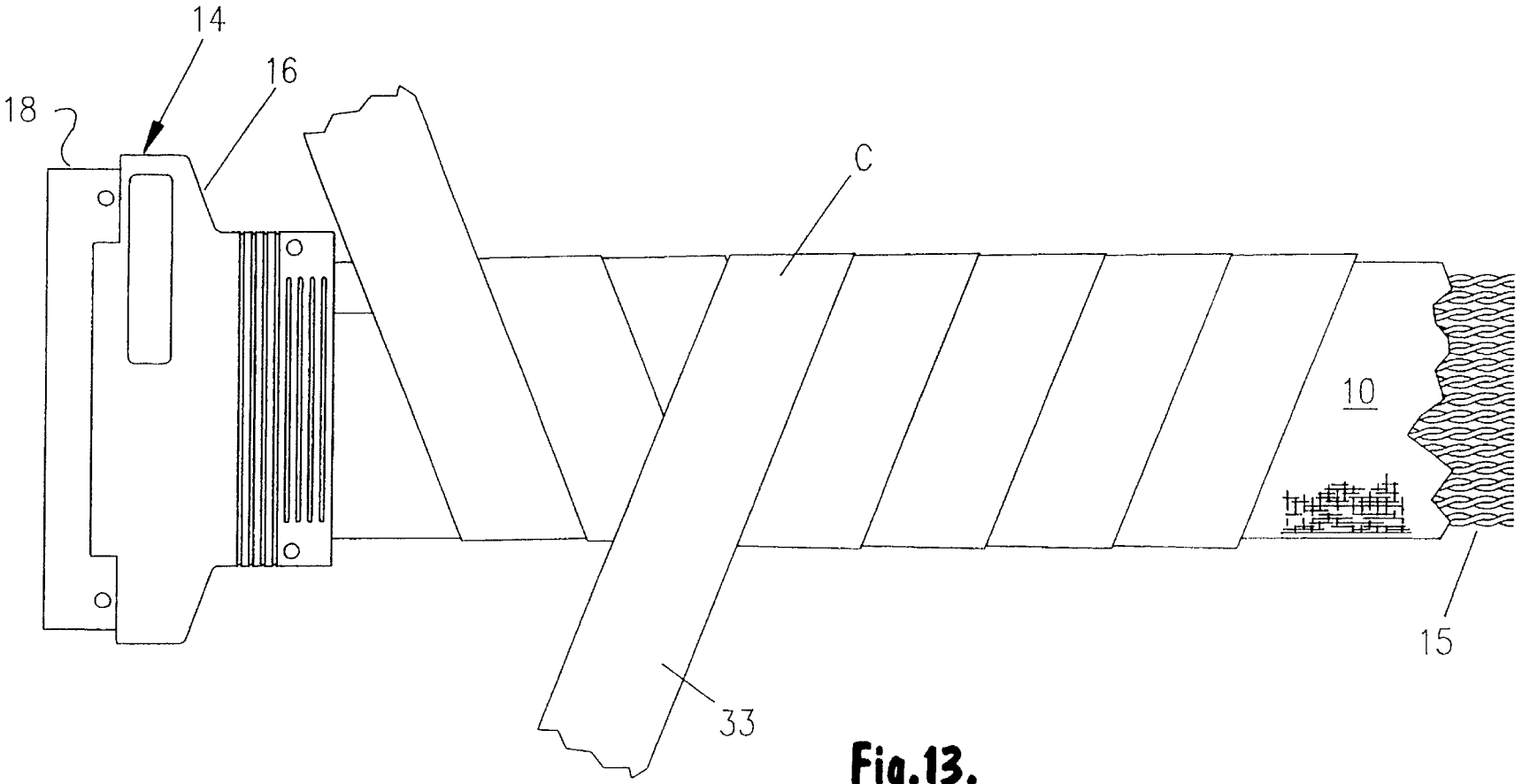
FIG. 13 is a top plan view of an electrical transmission cable assembly according to the invention having twisted pair conductors.
Figure 15:
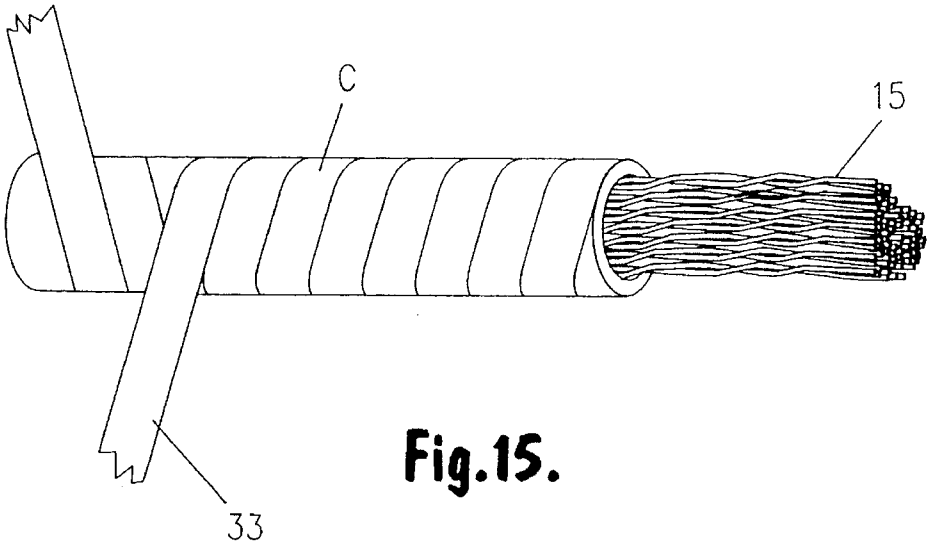
FIG. 15 is a perspective view indicating a round electrical transmission cable a incorporating a composite shield jacket according to the invention.

Referring now in more detail to the drawings, as can best be seen at FIGS. 2, 2*a*, a shielded woven electrical transmission cable assembly designated generally as A is illustrated which includes a flat woven electrical transmission cable 10 having a plurality of conductors 12 arranged generally side by side. In the illustrative embodiment, there are seven conductors 12*a* through 12*g*. Electrical transmission cable 10 may be any suitable conventional ribbon cable such as the woven electrical transmission cable disclosed in U.S. Pat. No. 4,143,236 incorporated by reference. Alternately the invention may also be used with a round or tubular electrical transmission cable 13 (FIG. 15), and as shown in more detail in U.S. Pat. Nos. 4,229,615 and 4,504,696, incorporated by reference; and the conductors may also be twisted pairs 15 (FIG. 13).

An electrical connector member is illustrated terminating one end of the electrical transmission cable, designated generally as 14. The connector member includes a housing 16 and a multi-position connector 18 carried by the housing as can best be seen in FIG. 2. There is a printed circuit (PC) board 20 carried within the housing 16 for terminating the electrical transmission cable 10 in a conventional manner. In the illustrative embodiment, PC board 20 includes a ground plane 22 and a signal plane 24. Ground wires 13 in the cable are terminated to ground plane 22 and the signal wires 12 are terminated to the signal plane 24. The signal wires 12 are terminated at individual pads 24*a* that are connected by plated electrical traces to certain ones of the sockets 18*a* of multi-position connector 18 in a conventional manner. Electrical connectors without PC boards may also be used with the present invention where termination is made directly to the positions of the multi-position connectors.

Figure 1:
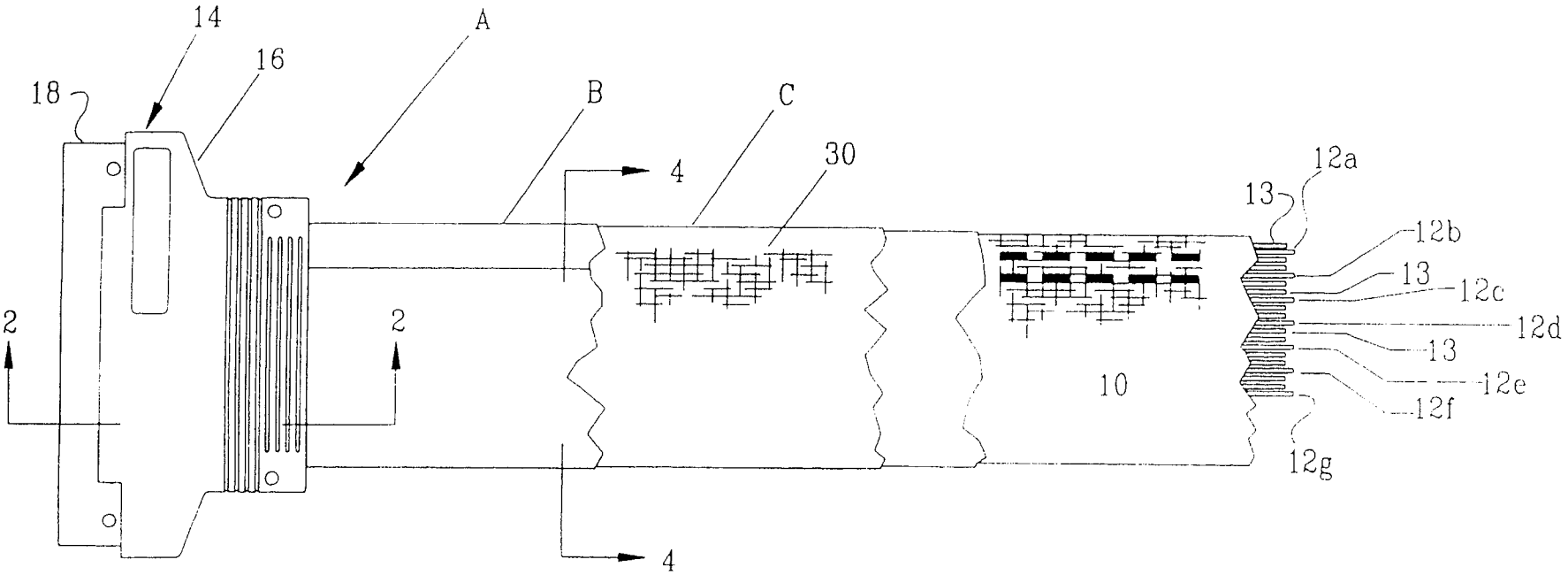
FIG. 1 is a top plan view of a shielded woven electrical transmission cable assembly constructed in accordance with the invention with layers of the cable assembly cut away.
Figure 7:
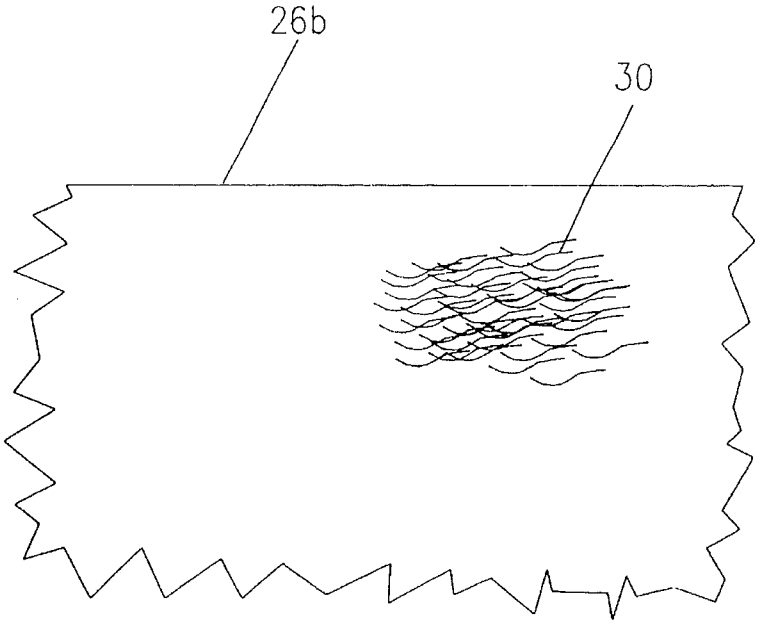
FIG. 7 illustrates another embodiment of a shield cloth according to the invention constructed from non-woven metallic fibers.
Figure 6:
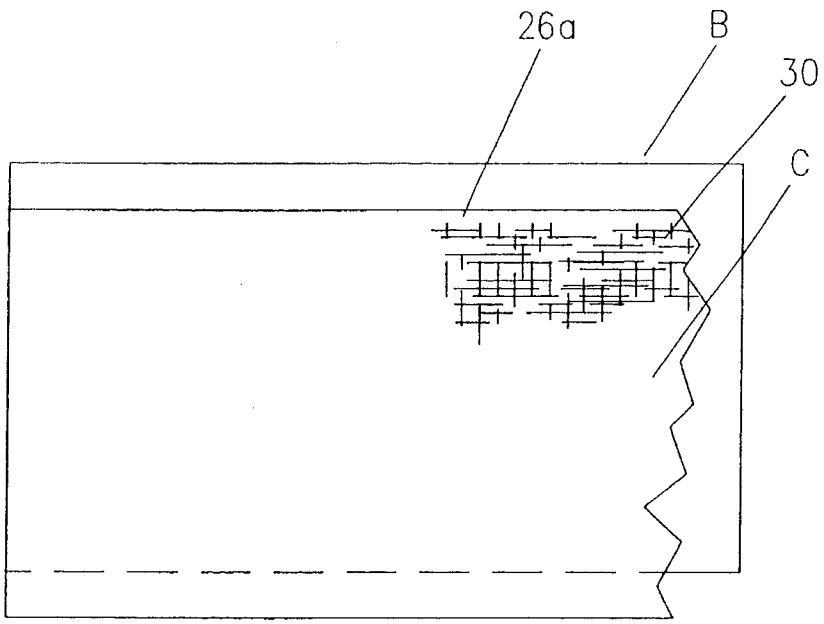
FIG. 6 is a top plane view of a composite shield jacket constructed according to the invention from shield cloth woven from metallic coated fibers.
Figure 14:
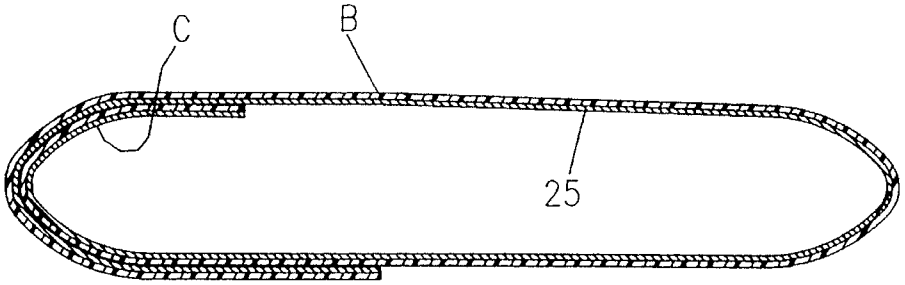
FIG. 14 is a sectional view illustrating a composite shield jacket for an electrical transmission cable wherein the conductive layer comprises a metalized backing applied to a back side of an outer elastomeric cover.

Referring again to FIG. 1, it can be seen that a conductive layer C is wrapped about electrical transmission cable 10 for conducting unwanted electrical noise. An elastomeric cover B surrounds conductive layer C and preferably is secured thereto. Conductive layer C may be a metalized shield cloth layer, or a metalized layer formed by applying a thin metal layer C to the backside of elastomeric cover B, i.e. a coating 25 (FIG. 14). Means for securing the shield cloth to the elastomeric cover to provide an integral composite shield jacket may include chemical, mechanical or heat bonding. For example, adhesive bonding may be utilized to secure the shield cloth and elastomeric cover together prior to the cable being inserted in the shield jacket. Most advantageously, shield cloth C is provided by a flexible fibrous web which includes metallic coated fibers for conducting the unwanted noises. The flexible fibrous web provides a highly flexible electrical shield with increased durability when secured with the elastomeric cover in the cable assembly. A suitable shield cloth is manufactured by the Monsanto Company of St. Louis, Mo. and is sold under the trademark FLECTRON™. The fabric includes metallic coated nylon fibers 30 provided either in a woven web 26*a* (FIG. 6) or non-woven web 26*b* (FIG. 7). The fibers may be plated with copper, silver, or nickel, or other suitable conductive material. In the woven configuration, the weave may either be a plain weave or a rip-stop weave.

Figure 4:
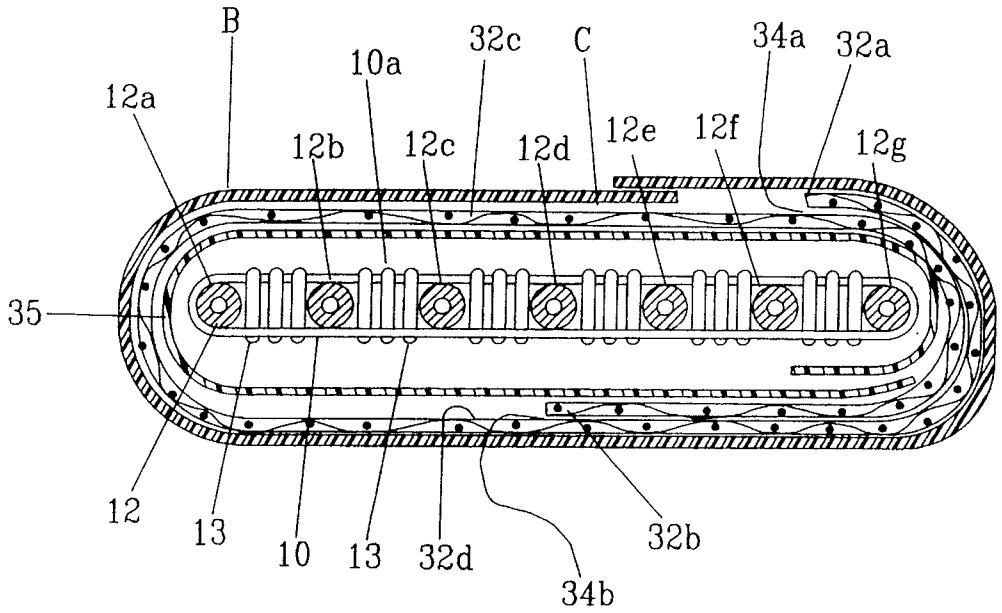
FIG. 4 is a sectional view taken along line 4—4 of FIG. 1.
Figure 5:
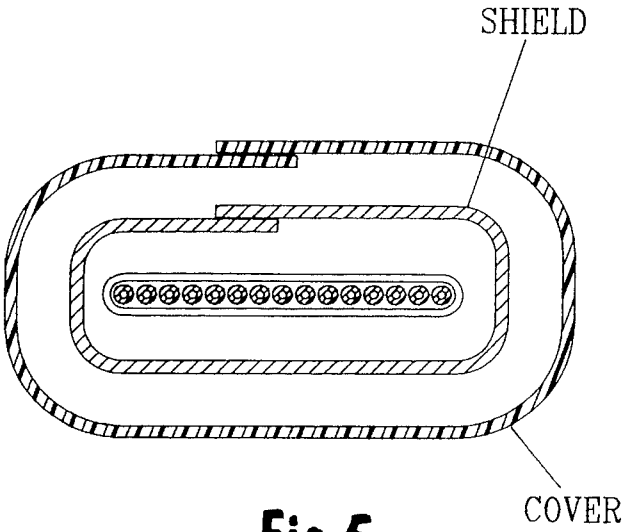
Fig.5. PRIOR ART
FIG. 5 is a sectional view corresponding to FIG. 4 of a prior art shielded cable.
Figure 12:
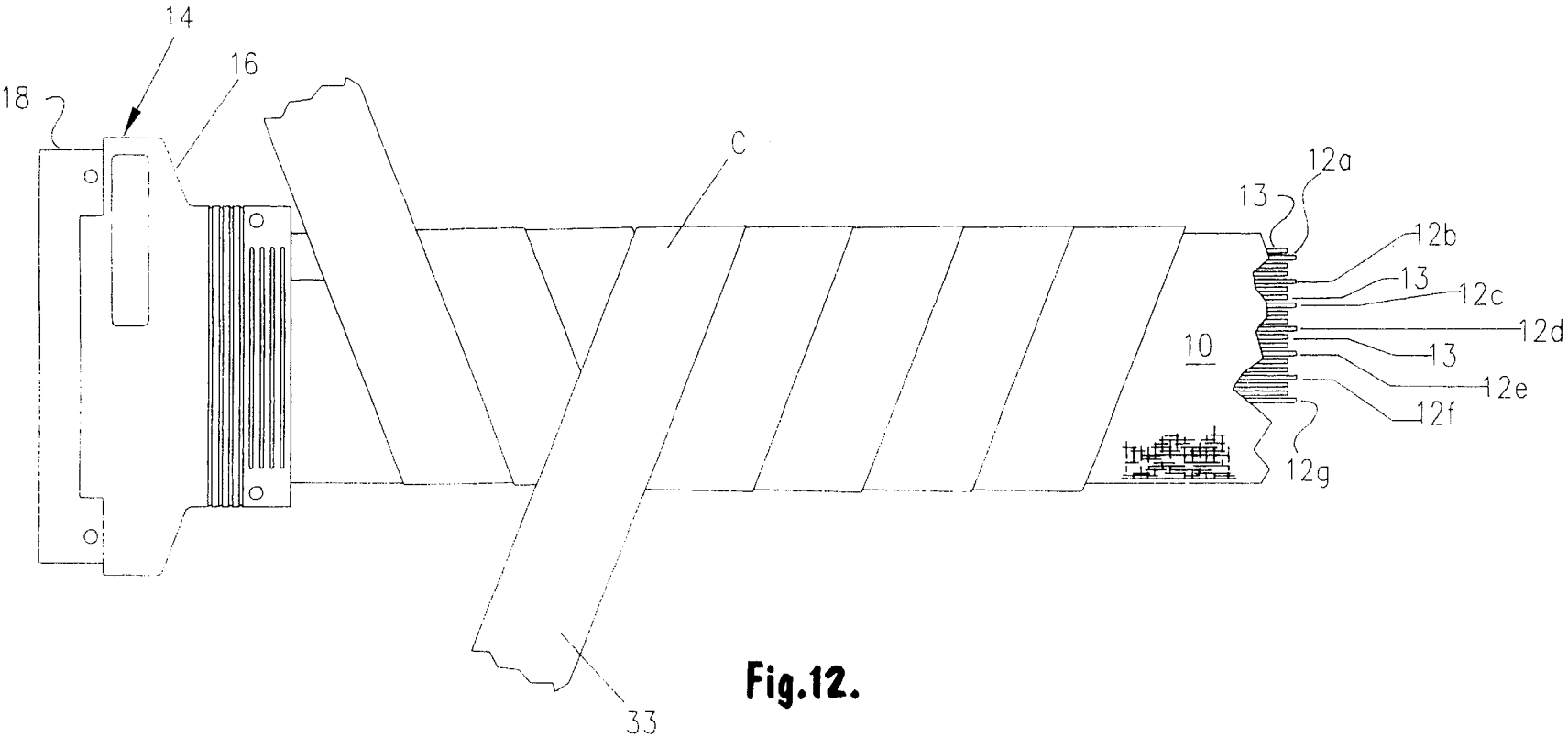
FIG. 12 is a top plan view of an electrical transmission cable assembly according to the invention wherein the composite shield jacket is spiral wrapped about the cable.

Shield cloth C surrounds the electrical cable 10 in an overlapped manner, as can best be seen in FIG. 4, which has been found, quite unexpectedly, to be highly advantageous. As illustrated, shield cloth C includes a first end 32*a*, a second end 32*b*, a first shield side 32*c* and second shield side 32*d*. First end 32*a* of the shield cloth is disposed on a first side 10*a* of transmission cable 10, and overlaps first side 32 of the shield. First end 32*a* of the shield cloth overlaps first side 32*c* of the cloth. Second end 32*b* of a shield cloth overlaps second side 10*b* of the transmission cable 10. Second side 32*d* of the shield cloth is disposed on the second side 10*b* of the cable and is overlapped by second end 32*b* of the shield cloth so that exits 34*a* and 34*b*, defined at the first and second ends of the shield cloth, are disposed on opposing sides of electrical transmission cable 10 to minimize escape of unwanted electrical noise. The curve path required between the exits also enhances reduction of escaped noise. Alternately, the shield jacket may be a spiral wrap 33 formed about the transmission cable (FIGS. 12 and 13), which may be doubled, while still retaining significant advantages of the invention.

Optionally, in application where inflammability requirements must be met, a thin layer of flame-proof or flame retardant tape 35 may be wrapped or bonded to the shield cloth in a one-piece composite construction on cable 10 between the cable and shield cloth C (FIG. 4). The tape stops short of connector housing 16 in FIG. 2. A suitable flame retardant tape is available from the Monsanto Company of St. Louis, Mo. The flame retardant tape may also be bonded to the shield cloth in a one-piece composite construction.

Figure 3:
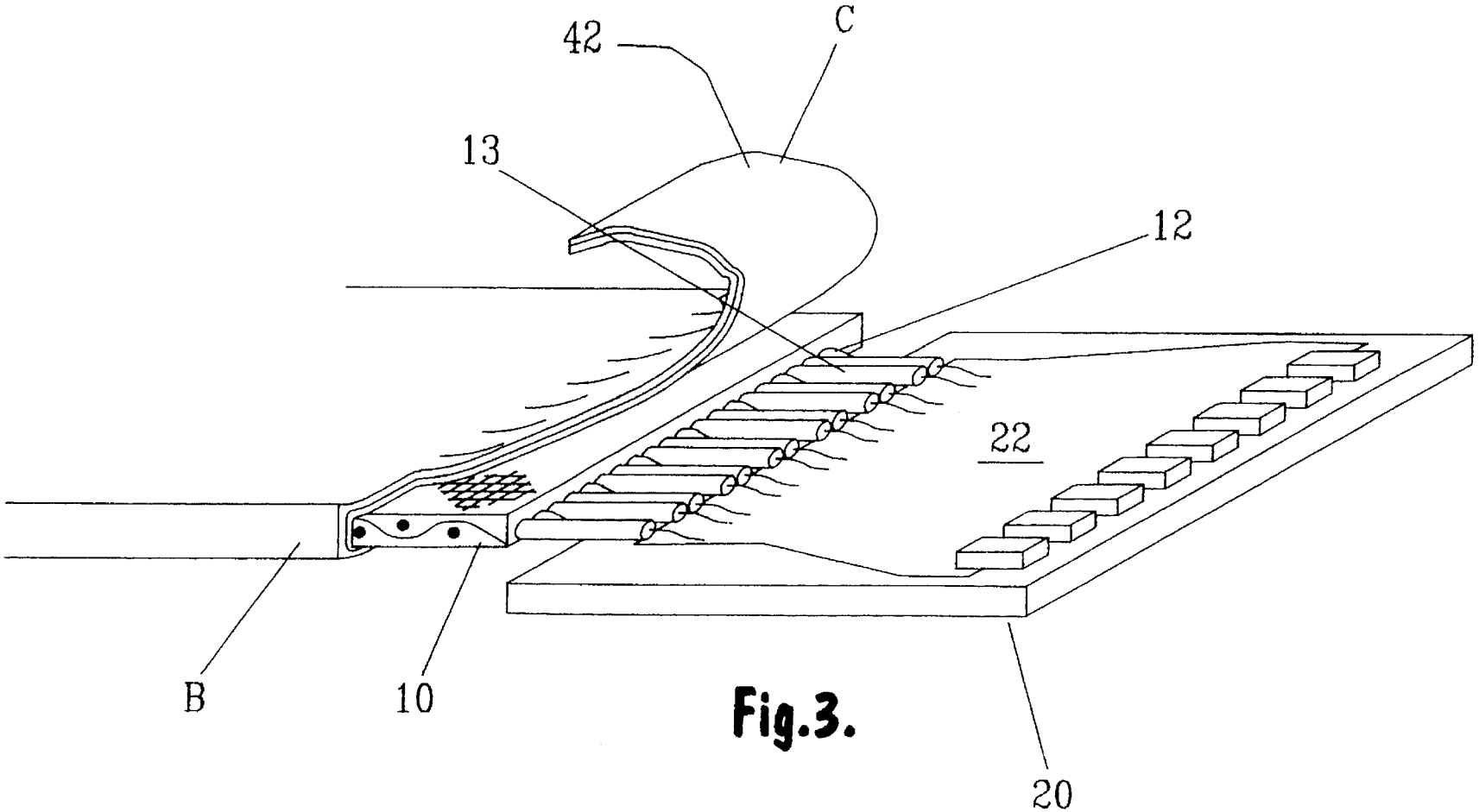
FIG. 3 is a perspective view with parts separated illustrating a woven electrical transmission cable shielded with a fibrous web shield cloth and termination according to the invention to the ground plane of a PC board.

As can best be seen in FIGS. 2 and 3, termination means D is provided for terminating shield cloth C to ground plane 22 of PC board 20. In the preferred embodiment, termination means D comprises an elongated conductive element 36 having a first contact 38 and a second contact 40. Shield cloth C includes a cloth tab 42 which is affixed to first contact 38 and is conductive therewith. At least one of the electrical contacts 38, 40 is constructed and arranged to be resilient so that element 36 may be compressed within connector housing 16 to make contact with ground plane 22, as can best be seen in FIG. 2. For this purpose, second contact 40 contacts ground plane 22 on PC board 20 when the cable 10 assembly and element D are enclosed within the housing 16.

In the illustrated embodiment, as can best be seen at FIGS. 2, 2*a*, termination element 36 is in the form of a copper spring element wherein the first contact 38 includes a strip having a plurality of segmented contacts 38*a* which flex independently from each other. In like manner, second contact 40 is a strip having a plurality of segmented contact pieces 40*a* which are independently resilient with respect to each other. In this manner, effective contact is made all the way across first and second contacts 38 and 40 by the individual flexing of the contact elements. As can best be seen in FIG. 2 and 2*a*, first contact 38 terminates in a bend 42, and an intermediate side 44 connects bend 42 with a bend 46. Contact 40 extends from bend 46 to the end of contact 40. In this manner, Contact 40 is resilient as it flexes about bend 42 when compressed between housing 16 and ground plane 22 of printed circuit board 20. Contact strip 3 provides a clip to secure tab 42 of cloth C, as can best be seen in FIG. 2. Cloth tab 42 is sandwiched between contact 38 and intermediate side 44 when squeezed together.

In another embodiment, means for terminating conductive layer C includes a window 60 formed by wrapping a second outer cover H (FIG. 11), having a window cutout, around shield cloth C near connector housing 16. Window 60 exposes the shield cloth (or metalized backing) so that an external ground bar and the like may be brought into contact with the conductive layer.

Figure 8:
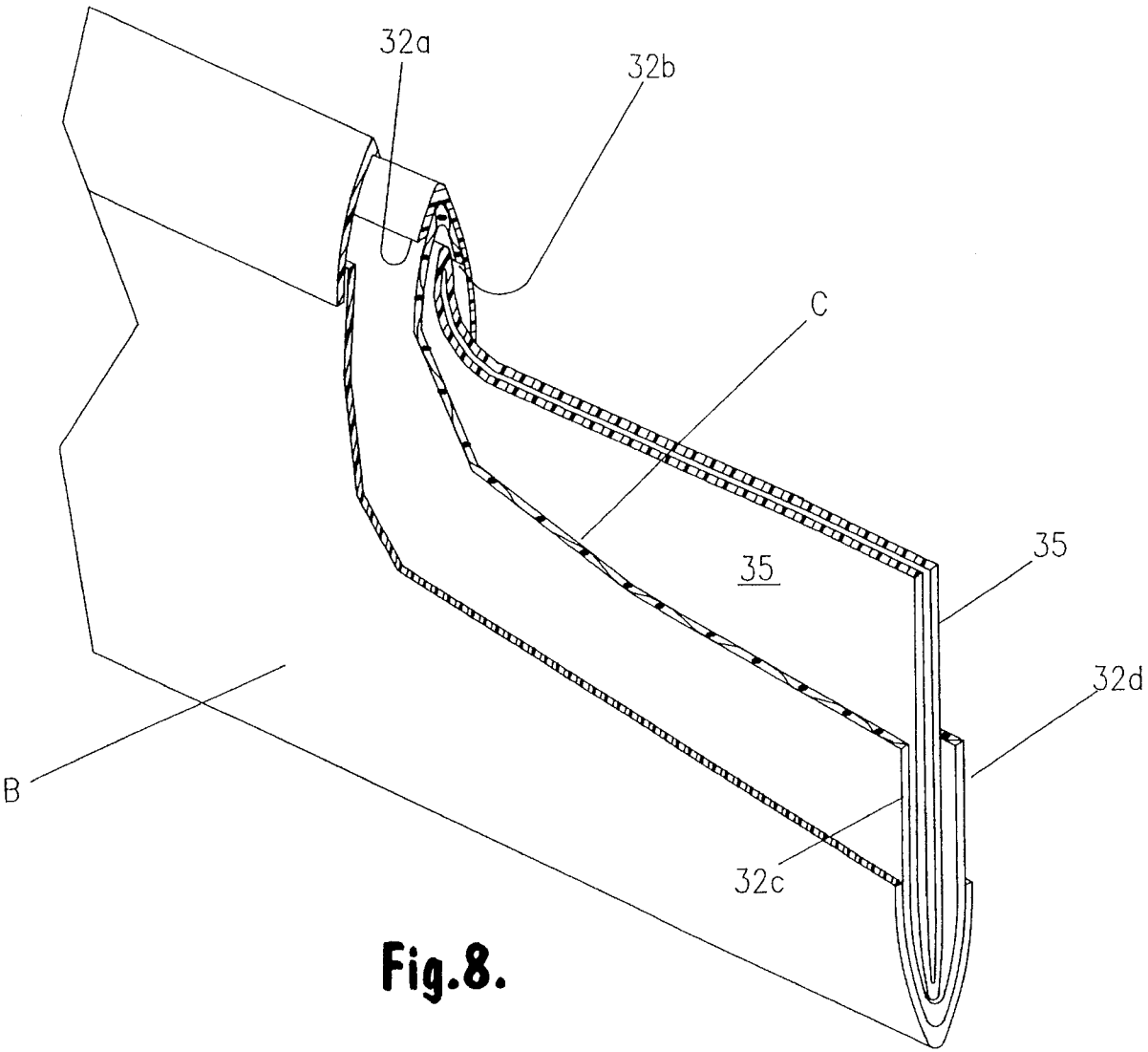
FIG. 8 is a perspective view of layers cut away illustrating a composite shield jacket for an electrical transmission cable constructed according to the present invention.
Figure 9:
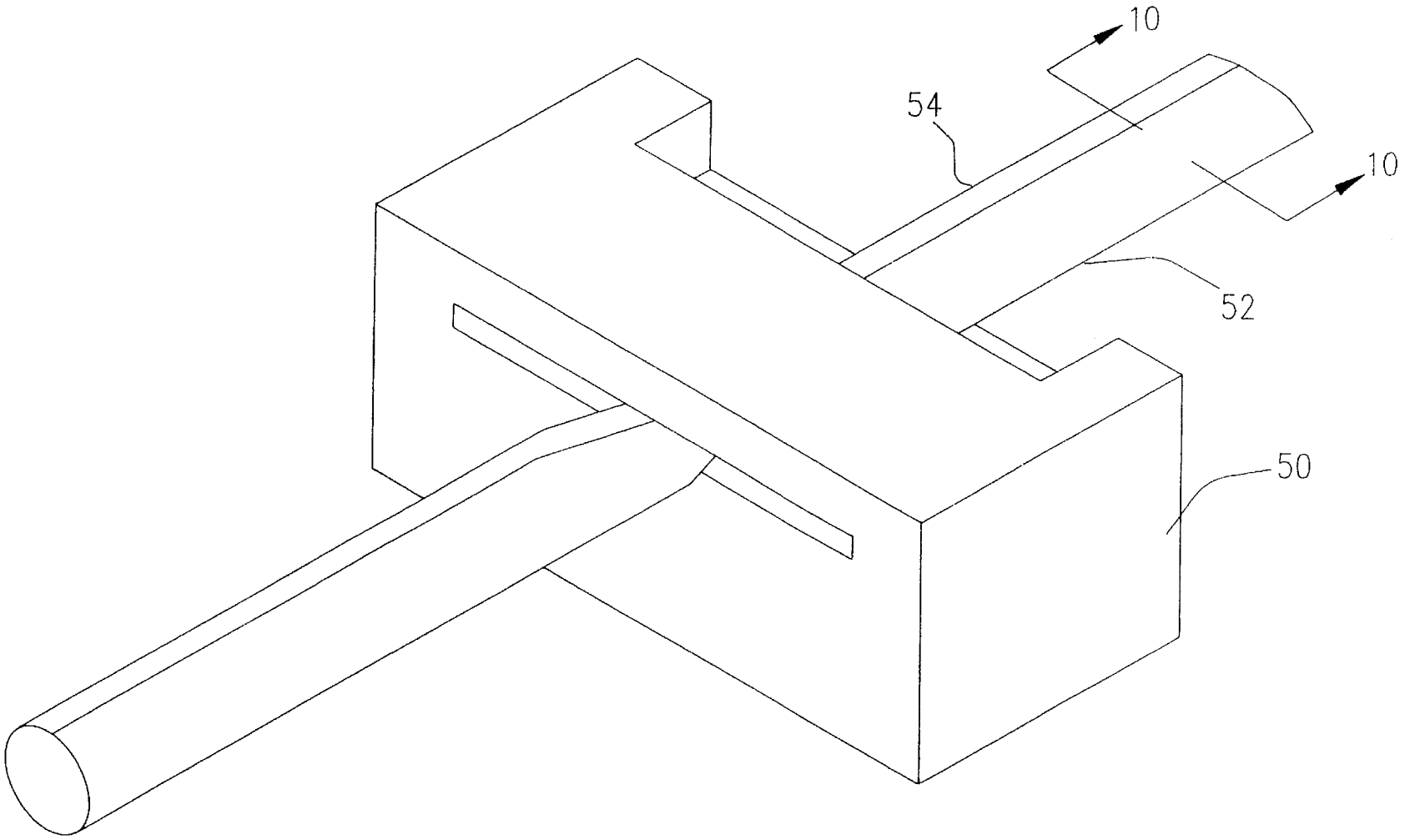
FIG. 9 is a perspective view illustrating a method for forming a flat composite shield jacket according to the invention in which a flat ribbon cable may be jacketed.
Figure 11:
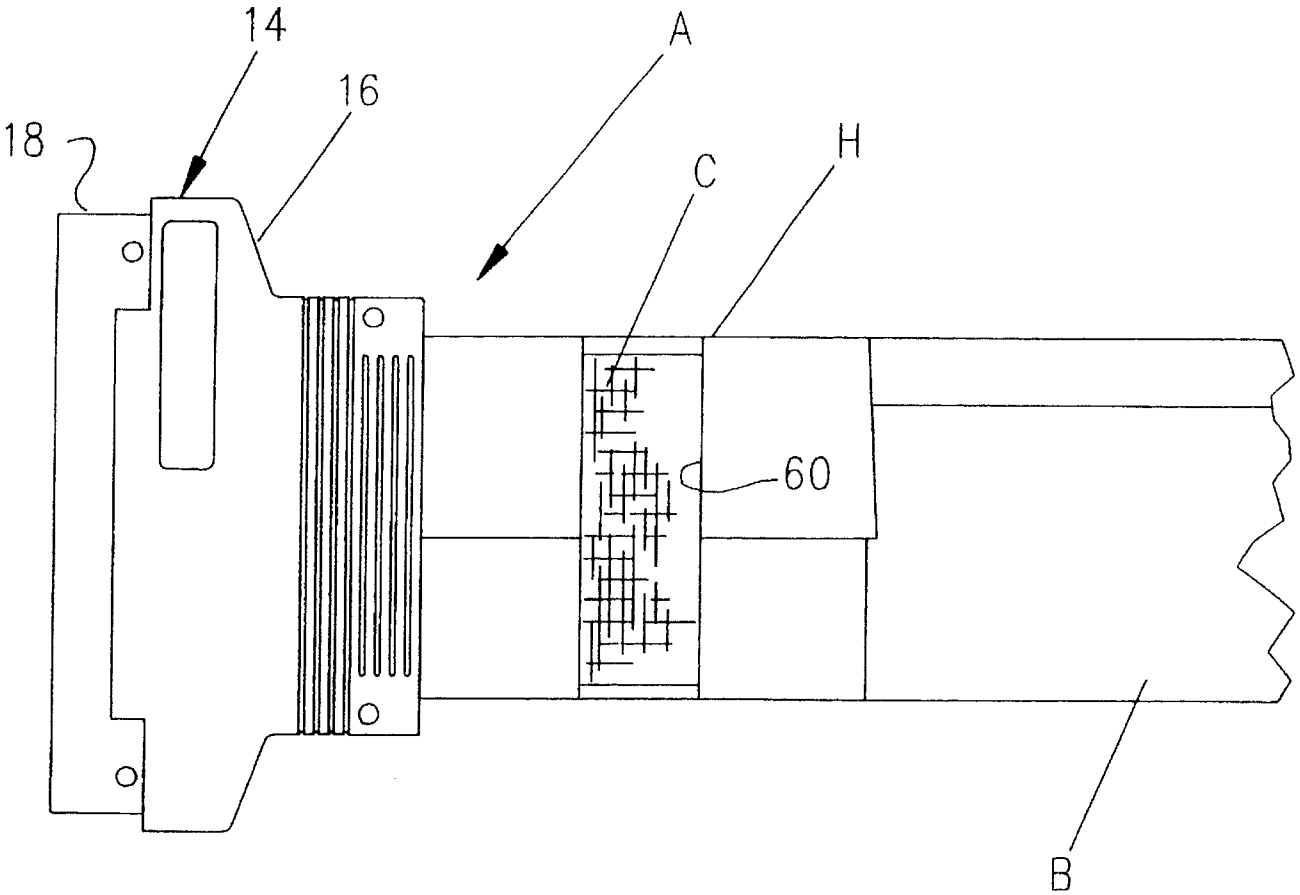
FIG. 11 is a plan view illustrating an electrical cable assembly having a composite shield jacket according to the invention with an exterior window exposing a conductive shield layer for termination to an external ground plane.

Thus, in accordance with the invention, a composite shield jacket is provided for shielding a flat ribbon cable, as can best be seen in FIGS. 8 and 11, which includes outer elastomeric cover B and inner shield cloth C secured together in an integral shield jacket in which a flat ribbon cable may be jacketed. As an option, flame proof layer 35 may be included between the shield cloth C and electrical transmission cable 10. In the shield jacket, the shield cloth is folded so that first end 32*a* is overlapped by first side 32*c*, and second end 32*b* of the shield cloth overlaps second side 32*d*. A first exit 34*a* is defined between first end 32*a* and first side 32*c* at the shield cloth. Second exit 34*b* is defined between second end 32*b* and second side 32*d* of the shield cloth. In this manner, whenever the shield jacket is flexed in a vertical plane, the exit on the opposite side of the cable will be pulled tight even if the exit on the side of the cable in the direction of the bend becomes puckered. In this manner, unwanted electrical noises are prevented from escaping, but instead are conducted way by the shield.

In accordance with the method of making the shield jacket according to the invention, the elastomeric cover B and shield cloth C are secured together and folded in the preferred configuration as can best be seen in FIG. 8. The tubular jacket is then fed through a processing station illustrated schematically at 50. The tubular configuration of the shield jacket is heated and flattened so that creased edges 52 and 54 are formed which maintain the shield jacket flat and also increase its flexibility.

Figure 10:
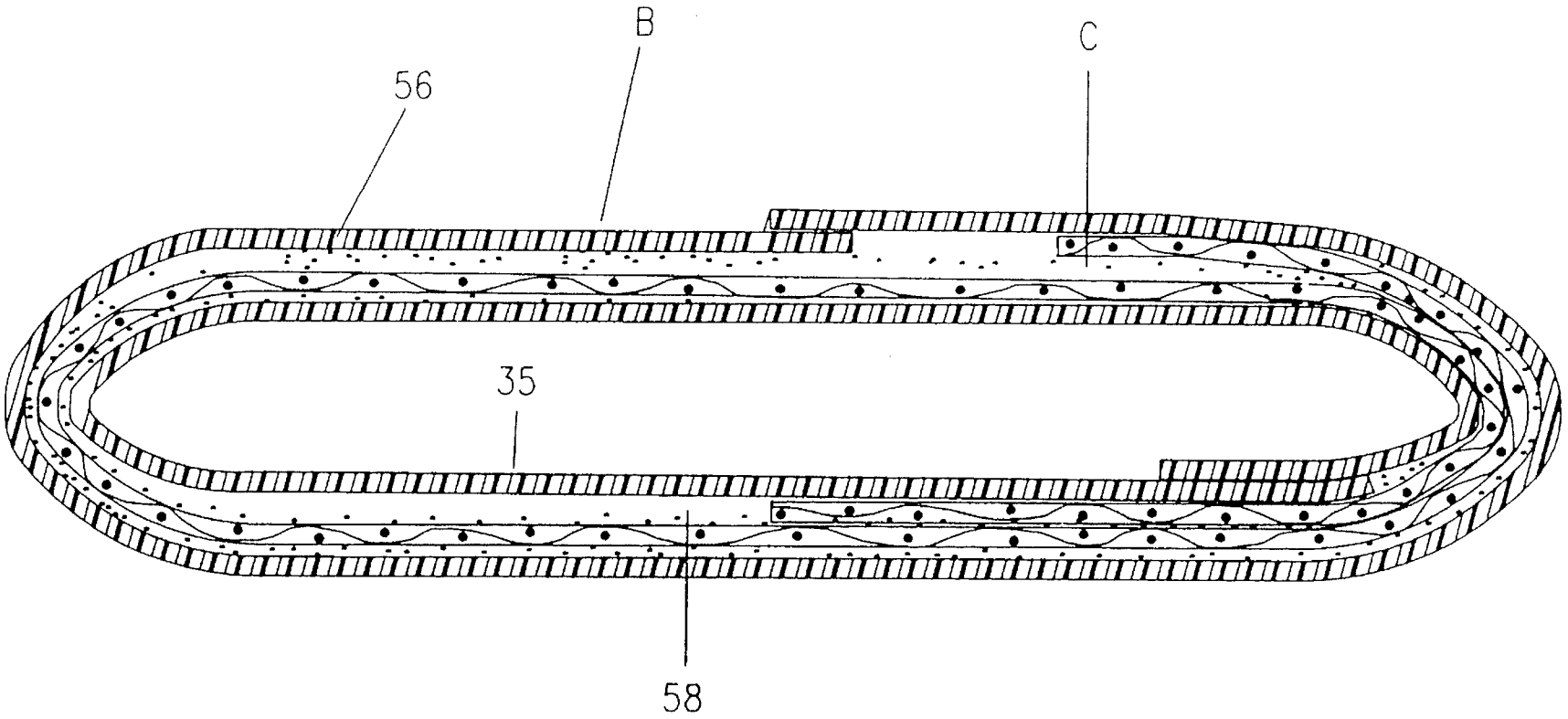
FIG. 10 is a sectional view taken along section line 10—10 of FIG. 9.

As can best be seen in FIG. 10, the composite shield jacket E includes elastomeric cover B, adhesive layer 56, conductive shield cloth C, adhesive layer 58, and tape layer 35.

While a preferred embodiment of the invention has been described using specific terms, such description is for illustrative purposes only, and it is to be understood that changes and variations may be made without departing from the spirit or scope of the following claims.

What is claimed is:

1. A composite shield jacket which is flexible and durable for shielding and protecting an electrical transmission cable comprising:

an outer elastomeric cover;

an inner electrically conductive shield cloth for conducting unwanted electrical noises comprising a flexible fibrous web formed from metallic coated fibers providing a highly flexible electrical shield; and means for securing said elastomeric cover and shield cloth together to form a composite shield jacket having increased structural integrity and flexibility for encasing said electrical transmission cable.

2. The device of claim 1 wherein said cable to be shielded is flat and has first and second sides; and said shield cloth is folded for encasing said first and second sides of said cable to be shielded to provide a first overlap at a first edge of said cable to be shielded so that a first end of said shield cloth is disposed on said first side of said cable when enclosed by said shield cloth, and a second end of said shield cloth is disposed on said second side of said cable to be shielded so that first and second exits are defined between said first and second end of said shield cloth and said first and second sides of said cable A which are located on opposite sides of said cable for minimizing the escape of unwanted electrical noises.

3. The device of claim 1 wherein said means for securing said shield cloth and elastomeric cover includes a chemical bonding.

4. The device of claim 1 wherein said shield cloth comprises a tab formed on an end of said shield cloth for terminating said shield cloth.

5. The device of claim 1 wherein said shield cloth includes a web woven from said metallic coated fibers,

6. The device of claim 1 wherein said shield cloth includes a non-woven web of metallic coated fibers.

7. A composite electrical shield jacket which is flexible and durable for shielding and protecting a flat electrical transmission cable having a plurality of conductors comprising:

an outer elastomeric cover;

an inner flexible electrically conductive shield for conducting unwanted electrical noises;

said conductive shield including a conductive shield cloth for surrounding said flat electrical transmission cable to be shielded to conduct unwanted electrical noise;

said shield cloth including a highly flexible fibrous web for surrounding and enclosing said flat cable to be shielded on first and second sides of said flat cable; and said fibrous web being formed from one of a woven web and non-woven web composed of metalized fibers providing a highly flexible electrical shield jacket with increased durability.

8. The device of claim 7 wherein said shield includes first and second ends, a first shield side, and a second shield side; said first side of said shield being disposed on a first side of said cable when surrounding said cable and overlapping said first end of said shield and said second side of said shield being disposed on a second side of said cable when surrounding said cable and being overlapped by said second end of said shield.

9. The device of claim 7 wherein said electrical transmission cable to be shielded is of the type having an electrical connector with a PC board for terminating said conductors of said electrical transmission cable; and wherein said shield comprises:

a shield cloth formed from metalized fibers;

a cloth tab formed at an end of said shield cloth for terminating said shield cloth to said PC board; and means a termination device for terminating said cloth tab to said PC board.

10. The assembly of claim 9 wherein said termination device includes:

a conductive termination element;

said termination element including a first contact, and a second contact;

said shield cloth being connected to said first contact of said termination element;

said second contact of said termination element being constructed and arranged to contact said ground plane of said PC board when said cable and element are enclosed within said housing; and at least one of said contacts being resiliently constructed and arranged so that said one contact is resiliently engaged between said housing and said ground plane with said ground plane terminating said shield cloth.

11. The device of claim 7 including means for securing said shield and elastomeric cover together to form an integral composite shield jacket.

12. A method for producing a composite shield jacket for electrically shielding and protecting a flat electrical transmission cable comprising:

providing elastomeric material to form an outer cover;

providing a conductive shield cloth to form an inner layer for conducting unwanted electrical noises comprising a flexible fibrous web formed from metallic coated fibers providing a highly flexible shield; and securing said elastomeric material and shield cloth together to form a composite tubular jacket having increased structural integrity.

13. The method of claim 12 wherein said transmission cable is flat, and said method includes subjecting said composite tubular jacket to a process to flatten said tubular jacket and form a flat shield jacket having substantially creased edges and increased flexibility.

14. The method of claim 12 including securing said shield cloth and elastomeric material together by bonding to enhance the structural integrity of said shield jacket.

15. The method of claim 12 including flattening said tubular jacket by press heating.

16. The method of claim 12 including forming said shield jacket so that a first end of said shield cloth is disposed on a first side of said transmission cable and a second end of said shield cloth is disposed on a second side of said transmission cable to define first and second exits between said first and second ends of said shield cloth and said first and second sides of said cable which are located on opposite sides of said electrical transmission cable for minimizing the escape of unwanted electrical noises.

17. The method of claim 12 wherein said shield cloth is provided in the form of a web woven from said metallic coated fibers.

18. The method of claim 12 wherein said shield cloth is provided in the form of a non-woven web of metallic coated fibers.

* * * * *